United States Patent [19]

Miller, Jr. et al.

[11] Patent Number: 4,657,208

[45] Date of Patent: Apr. 14, 1987

[54] ROTATING WARHEAD

[75] Inventors: Walter E. Miller, Jr.; Robert R. Mitchell, both of Huntsville, Ala.

[73] Assignee: The United States of America as represented by the Secretary of the Army, Washington, D.C.

[21] Appl. No.: 743,178

[22] Filed: Jun. 10, 1985

[51] Int. Cl.[4] ..... F41G 9/00; F42B 13/10

[52] U.S. Cl. ..... 244/3.22; 102/476

[58] Field of Search ..... 244/3.22, 3.21, 3.11, 244/3.1; 102/476

[56] References Cited

U.S. PATENT DOCUMENTS 4,262,596 4/1981 Allier et al. ..... 102/476

4,374,495 2/1983 Thomanek ..... 102/476

FOREIGN PATENT DOCUMENTS 2149066 6/1985 United Kingdom ..... 102/476

*Primary Examiner*—Charles T. Jordan

*Attorney, Agent, or Firm*—Freddie M. Bush; Robert C. Sims

[57] ABSTRACT

The method achieves a top soft armor attack with the favorable attack angle. In addition it eliminates the wiping motion. This is accomplished by a small upward exhausting thruster over the warhead. This thruster, activated on command from the launch station, institutes a rapid pitch down rotation of the missile imparting an angular momentum. This angular momentum produces a jet wiping effect in the opposite direction of that produced by the missile forward flight.

5 Claims, 18 Drawing Figures

ROTATING WARHEAD

DEDICATORY CLAUSE

The invention described herein may be manufactured, used, and licensed by or for the Government for governmental purposes without the payment to us of any royalties thereon.

SUMMARY OF THE INVENTION

The subject patent method achieves the top soft armor attack with the favorable attack angle using no seeker and no target approach sensor. In addition it eliminates, or in partial implementation greatly reduces, the wiping motion, and this eliminates the loss of penetration due to keyholing. This is accomplished by firing the direct fire, line of sight missile on an elevated trajectory over the target (fly over). However, instead of a target approach sensor, the missile possesses a small upward exhausting thruster over the warhead. This thruster, activated on command from the launch station (based on a range difference between missile and target, and measured by a laser rangefinder at the launch and control site) inititutes a rapid pitch down rotation of the missile. After a pre-set delay time, the warhead detonates, firing into the soft top of the armor. The significant improvement, however, is that the missile pitch angular rate (the missile is at this time tumbling, not in a controlled flight maneuver) imparts an angular momentum to the forming jet. This angular momentum produces a jet wiping effect in the opposite direction of that produced by the missile forward flight.

DESCRIPTION OF THE BEST MODE AND PREFERRED EMBODIMENT

This invention disclosure describes a new and very novel method of obtaining greatly increased warhead performance from existing missile warheads. The method permits use of these existing warheads, incorporating the improved efficiency, without physical modification to the warheads themselves.

The method involves a different method of target attack, and is accomplished by a modification of the missile guidance (or other delivery mechanism) to achieve this improved efficiency. Incorporation of this method allows a direct fire, frontal impact missile to be used in a much more effective top attack mode, without suffering the warhead degradation presently imposed by other top attack methods.

Figure 1:
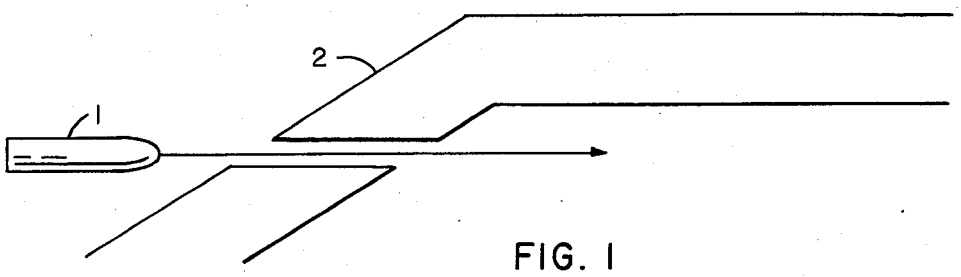
FIG. 1 shows a conventional line of sight direct fire missile frontal attack geometry.

FIG. 1 shows schematically, conventional line of sight direct fire missile frontal attack geometry as used by such anti-armor missiles as DRAGON, SHILLELAGH, or TOW. The missile flies directly into the tough frontal armor 2, and penetrates along a lengthly path as shown.

Figure 2:
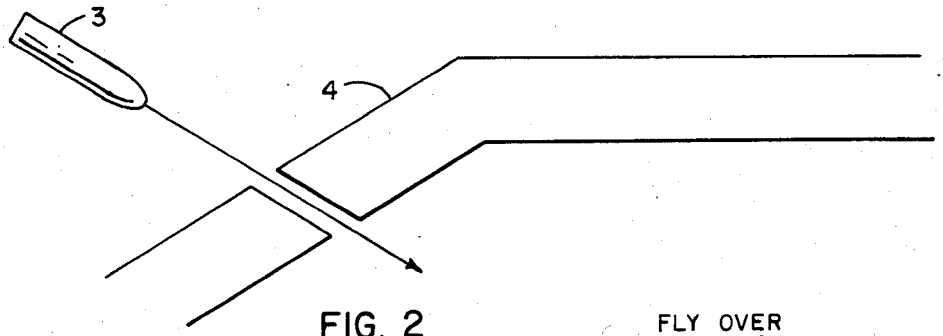
FIG. 2 shows a conventional terminal homing missile utilizing a seeker.

FIG. 2 shows a conventional terminal homing missile 3, utilizing seeker rather than line of sight guidance, as used in such missiles as HELLFIRE and MAVERICK. The missile still engages the target from the frontal aspect (the target 4 will attempt to keep his hardest armor toward his threat), but the terminal homing guidance permits the addition of a bias. This bias, electronically added, "shapes" the trajectory so the missile approaches the target from a more favorable angle—usually 10 to 30 degrees diving. This dive angle, while not accurately controlled, provides for a shorter penetration path through the hard (and sloped) frontal armor. This lack of precise angle control, coupled with the significantly more expensive seeker required for this guidance, limits usage at present to the large expensive missiles indicated.

Figure 3:
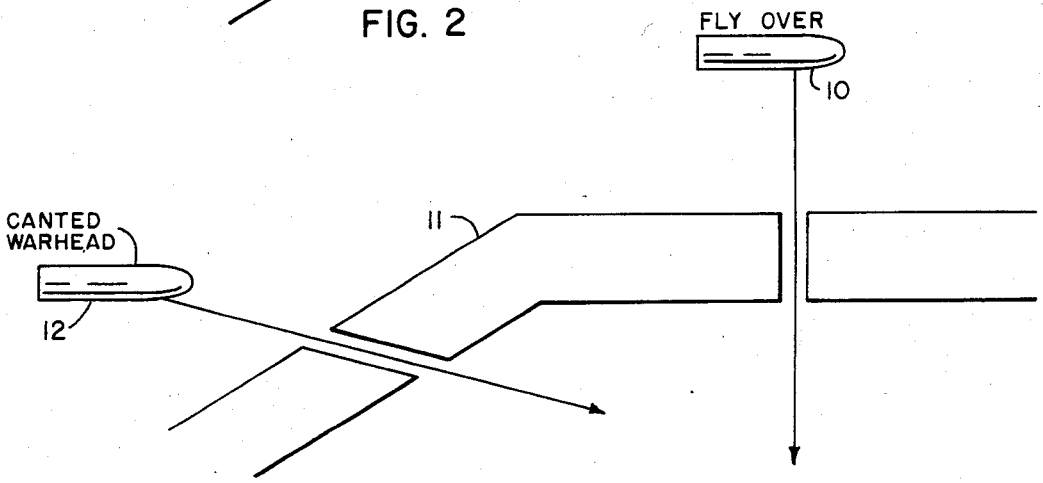
FIG. 3 shows both the line of sight and a fly over guided missiles.

FIG. 3 shows a newer method of using the line of sight, direct fire missile 10 and 12 to attack the softer top of the target 11 from a more favorable aspect. Two implementations are shown. The fly over missile 10 is intentionally flown over the top of the target. A special target-approach sensor is required on the missile to detonate a down firing warhead. The warhead can be either a conventional shaped charge (jet), or a self forging fragment (kinetic energy slug), and is intended to attack the lightly armored turret top from a favorable vertical angle. However if the target-approach sensor fails to accurately find this precise location, the vertical attack approach still provides improved geometry.

The canted warhead method (jet), flies an impact trajectory as in FIG. 1, but due to the warhead cant angle, penetrates along a path similar to FIG. 2. It can also incorporate the target-approach sensor of the fly-over implementation, to permit raising the (still flat) trajectory to reach thinner armor, but detonating on a near miss rather than flying by.

Figure 4A:
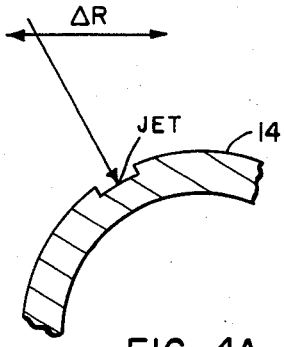
FIGS. 4A through 4C illustrate keyhole velocity wiping effects caused by a non-rotating missile.
Figure 4B:
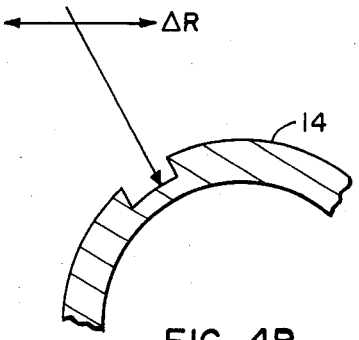
Figure 4C:
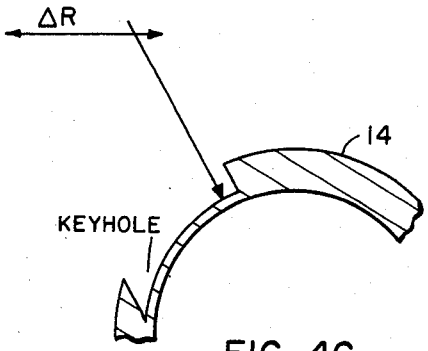

Both implementations of FIG. 3 suffer from a degrading factor called wiping. FIGS. 4A–4C show this effect in three time intervals. The jet tip initially contacts the target 14 and penetration begins. The missile forward velocity, however, causes the forward jet motion, R, during the target penetration process. This causes a sawing effect, commonly called keyholing, which removes additional target metal in a longitudinal direction. The extra energy used to saw this slot is extracted from the jet, reducing its penetration depth capability. If this effect causes failure to penetrate, target damage is minimal. Also if the jet does pentrate, the amount of jet, hot metal, etc. entering the tank is greatly reduced.

The subject patent method achieves the top soft armor attack of FIG. 3, with the favorable attack angle of FIGS. 2 and 3, using the very low cost (no seeker, no target approach sensor) of FIG. 1. In addition it eliminates, or in partial implementation greatly reduces, the wiping motion, and this eliminates the loss of penetration due to keyholing. This is accomplished by firing the direct fire, line of sight missile (FIG. 1) on an elevated trajectory over the target, similar to FIG. 3 (fly over). However, instead of a target approach sensor, the missile possesses a small upward exhausting thruster over the warhead. This thruster, activated on command from the launch station (based on a range difference between missile and target, and measured by a laser rangefinder at the launch and control site) institutes a rapid pitch down rotation of the missile. After a pre-set delay time, the warhead detonates, firing into the soft top of the armor. The significant improvement, however, is that the missilepitch angular rate (the missile is at this time tumbling, not in a controlled flight maneuver) imparts an angular momentum to the forming jet. This angular momentum produces a jet wiping effect in the opposite direction of that produced by the missile's forward flight. Computer simulation has shown that typical missile velocities of direct fire missile (100 to 300 meters second) produce forward jet wiping effects which can be essentially cancelled by the selection of a warhead firing angle, angular rate, and fire time.

Figure 4D:
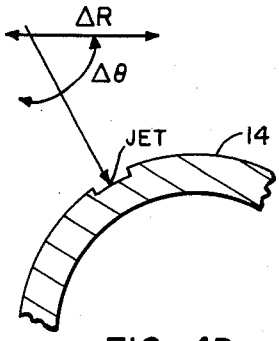
FIGS. 4D through 4F illustrate the correction of the wiping effect by missile rotation of the present invention.
Figure 4E:
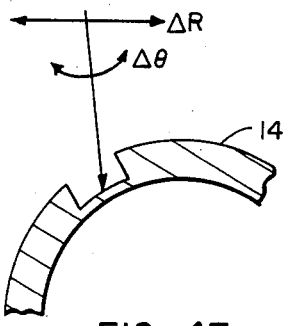
Figure 4F:
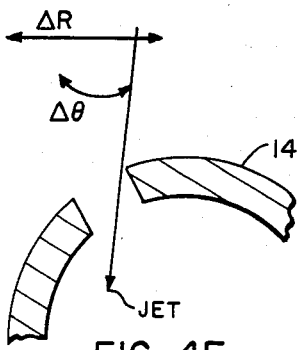
Figure 5:
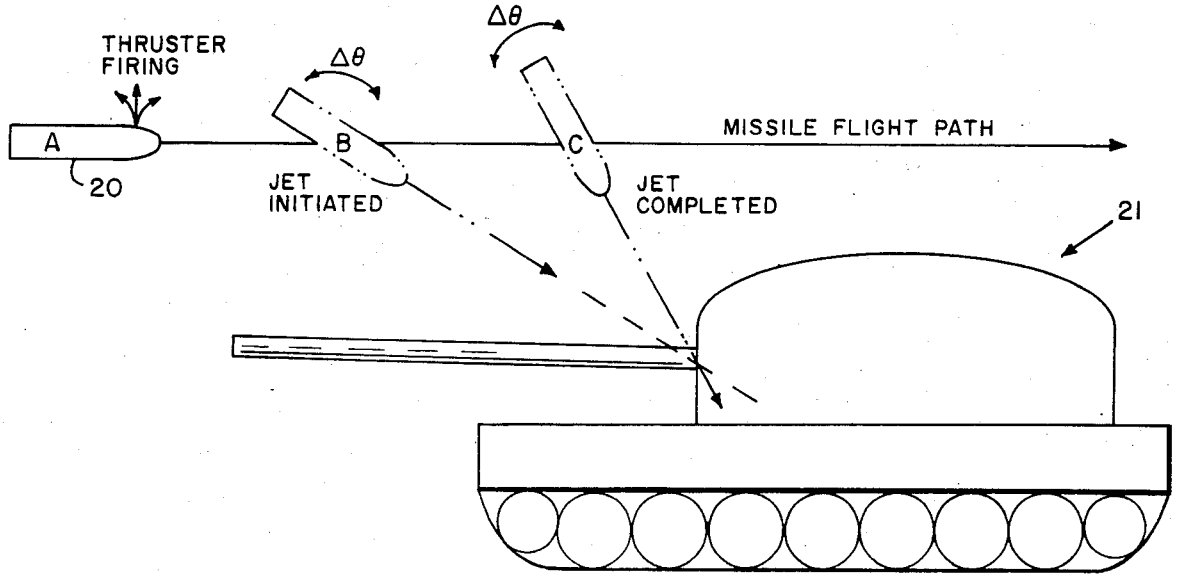
FIG. 5 illustrates the schematic showing of the present invention.

FIG. 5 shows a target area picture of the rotating warhead method in action. At A, a small thruster is fired, imparting an angular (pitch down) rotational velocity to the missile 20. At B the thruster firing is complete, the warhead has been initiated, and the jet tip started toward the target 21 at a certain impact point. At C the warhead explosion has been completed, and the jet tail is impacting the target near the same impact point due to the continued angular rotation of the warhead during jet formation (B and C is greatly exaggerated). Conservation of angular momentum produces a near no-wiping solution as shown in FIGS. 4D–4E where $\Delta\theta$ is the rotation the set (missile) goes through, as the missile travels $\Delta R$.

Figure 6:
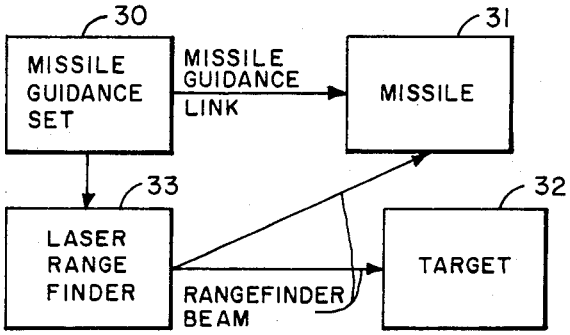
FIG. 6 shows the relationship in block form of the missile to support equipment.
Figure 7:
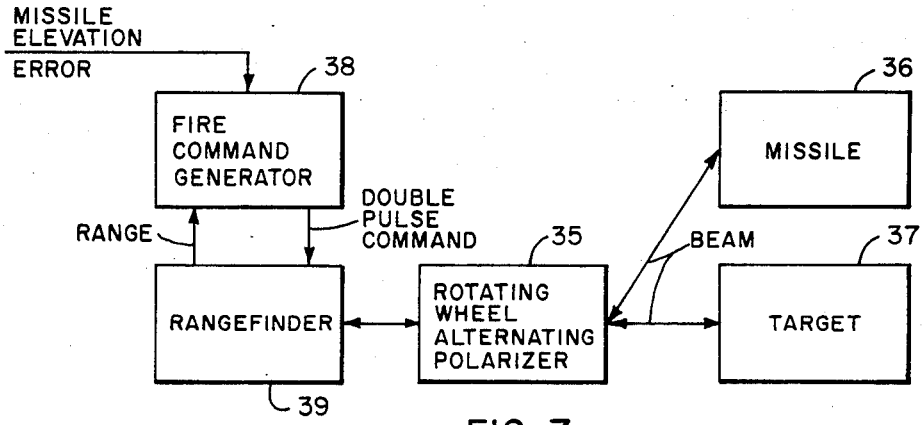
FIG. 7 illustrates in block form one possible configuration of the improved support equipment.
Figure 8A:
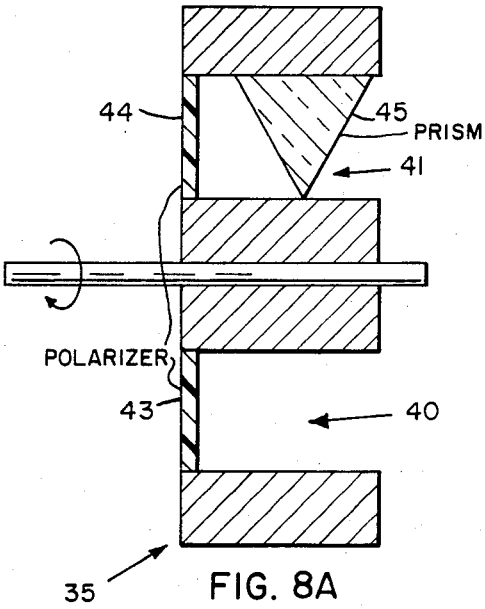
FIGS. 8A and 8B illustrate the construction of a rotating wheel.
Figure 8B:
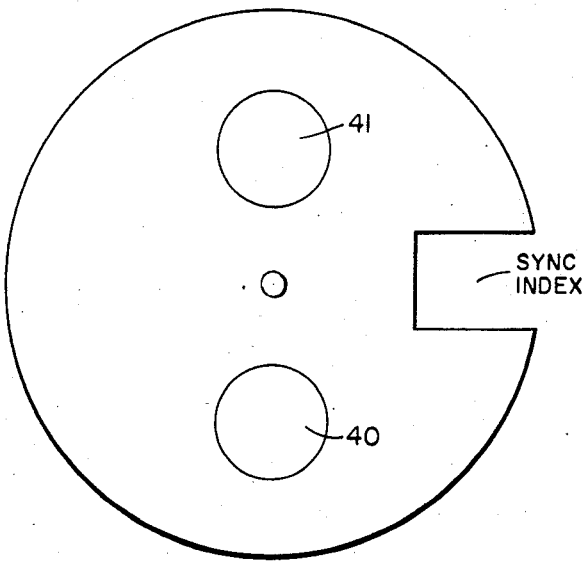

FIG. 6 shows a missile, incorporating the subject method, and its relationship to existing and conventional missile support equipment. The Missile Guidance Set 30 (MGS) controls the missile's flight in a fashion indentical to present TOW or DRAGON missiles. The missile 31 however, is directed over (instead of into) the target 32. The TOW MGS will perform this task acceptably for a TOW missile with this warhead. The laser rangefinder 33 is also a conventional existing subsystem, such as the GLLD (Ground Laser Locater Desinator of HELLFIRE). It now however ranges on both the target and the missile in flight. This is accomplished by augmenting the missile with an optical retrodirective prism (corner cube) covered with a linear polarizer (not shown). One possible rangefinder modification is shown in FIG. 7. A rotating wheel 35 (FIGS. 8A and 8B) is placed over the laser objective optics, and is rotated in syncronism, but at one half the rate of, the laser beam firing rate. Two optical apertures 40 and 41 are then alternately over the objective on successive laser firings. Aperture 40 contains a linear polarizer 43 oriented perpendicular to the polarizer on the missile 36. The laser will then range on the target 37 in its normal fashion, unhindered by the polarizer 43. However, the strong return that could occur from the missile corner cube is inhibited due to the crossed polarizers.

Aperture 41 contains a polarizer 44 and an optical wedge 45. This polarizer is matched to the missile, resulting in a very strong return. The wedge 45 also deviates the laser beam through an angle, and includes a slight curvature to widen the beam if necessary to further enhance the missile return. The wider beam covers a larger area to compensate for an imprecisely known missile location (the rangefinder operator, and the first beam, are always pointed directly to the target). The upward deflection from the wedge enhances the missile signature and eliminates "false" returns from the target. When the difference in range between the missile and target reaches a predetermined minimum value, the fire command generator 38 generates a thruster firing command. This causes the rangefinder 39 to transmit an "extra" or double pulses at the next missile firing time. This out-of-sync pulse is received by the missile, the double pulse time interval sensed, and interpreted as a delay time from reception to thruster firing.

Figure 9:
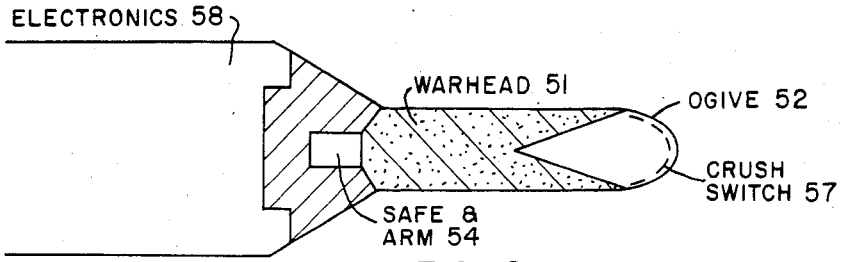
FIG. 9 PRIOR ART
FIG. 9 shows a prior art missile.
Figure 10:
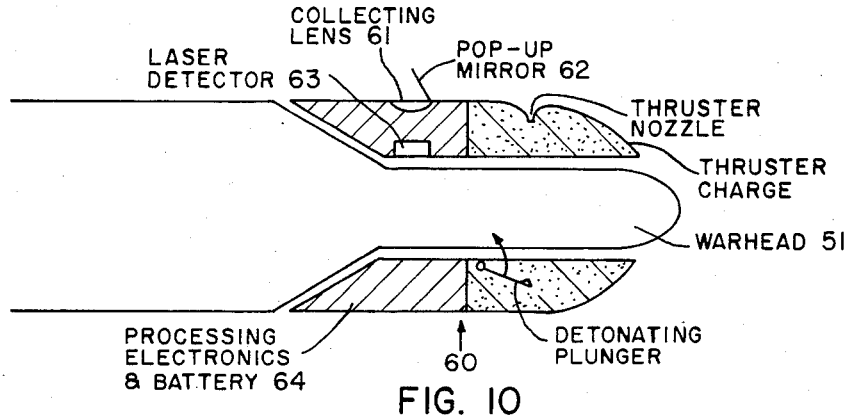
FIG. 10 shows a missile having a correcting cylinder around its warhead for performing the rotation.

FIG. 9 shows an existing sub-caliber missile warhead section. Shown are the electronic 58, warhead 51, ogive 52, crush switch 57 and safe and arm 54. FIG. 10 shows an attractive method for producing the rotating warhead from such a missile. A cylinder 60 is fitted over the warhead 51. A collecting lens 61 with a pop-up mirror 62 is located so as to collect the transmitted laser beam and feed this to laser detector 63. The processing electronics and battery 64 is located about the lens and detector. A thruster charge has a nozzle for causing angle rotation.

Figure 11:
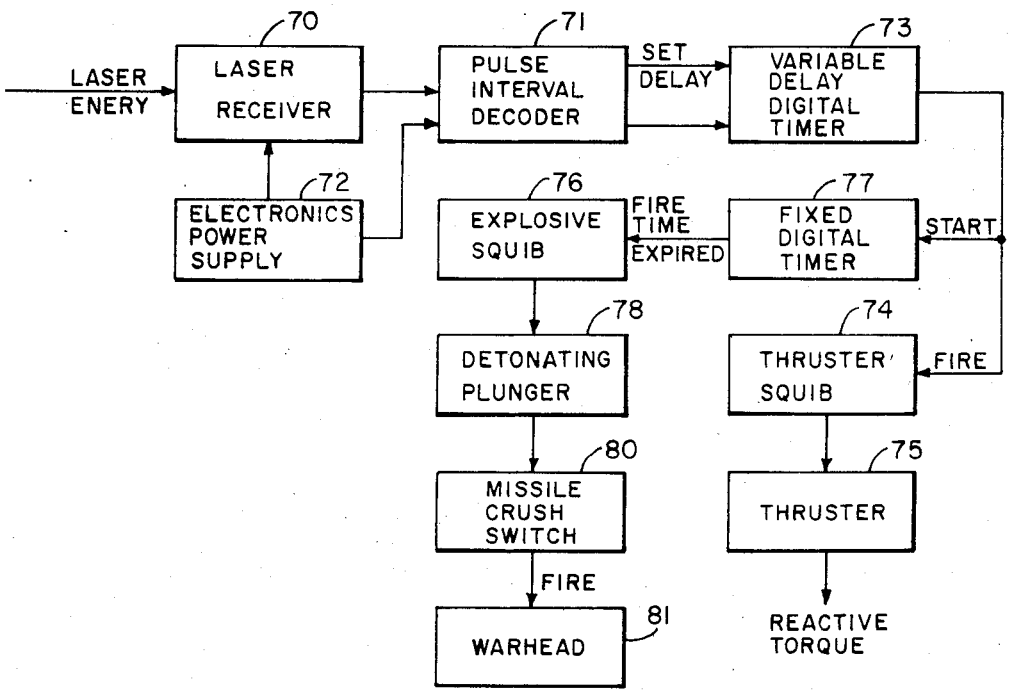
FIG. 11 illustrates in block form the functional relationship of the missile modification.

The processing electronics is shown in FIG. 11. It contains a laser receiver 70, a double pulse decoder 71, a battery 72 to operate electronics, a variable delay timer 73, a thruster firing circuit and squib 74, an explosive squib 76, a first delay timer 77, and a detonating plunger 78.

The functional block diagram of FIG. 11 illustrates the inventive method. Each laser pulse of proper polarization is received and processed by the receiver 70. When a double pulse occurs, a clock in 71 is started (on the first) and stopped (on the second). On a single pulse, the clock runs out of time and returns to zero, thus ignoring single pulses. The clock count from a double pulse is input directly to a variable time digital timer 73 (such as a register, comparator, and counter) at the same time the digital timer 73 is started. When it counts to a preset delay time (stored in the register), it outputs a "time expired" voltage, starting a second, but fixed time delay similar to counter 77. At this time, the first time expired voltage also fires the thruster squib 74 igniting the thruster 75, which places a pitch down reactive torque on the missile. Dur,ing this pitch rotation, the second fixed digital timer 77 is running, and on its expiration fires a second explosive squib 76. This squib, containing a metal plunger 78 similar to the TOW wire cutter squib, penetrates the existing missile ogive crush switch 80, which shorts the switch and activates the missile warhead 81 in its normal fashion--but now pitched down strongly with the pre-designed angular rate.

Other implementations can be used and may vary widely with different retrofitted missiles or new missiles. Such variations can easily be seen by missile guidance experts, and include: (1) Command the thruster firing over the missile guidance link rather than the laser. (2) Use existing target sensors to initiate the pitch thruster rather than command from the ground station. (3) Microprocessor controlled interfaces between the rangefinder and fire command generator (FIG. 7) to include measured missile attitude errors from the MGS (FIG. 6), successive range interval measurement from the rangefinder to record missile velooity variations, and modification of the thruster fire delay time to correct for these determinable errors. (4) Use of variable timing in the second (fixed) missile delay timer, to fire at various attack angles under control from the ground station. (5) Alternative laser codes, though variable pulse interval is an existing capability of present army equipment. (6) Multiple rangefinders for missile and target to permit faster data on the missile range. (7) Other less complex mechanism for detonation of the warhead, particularly in a specially designed new missile. This patent then claims the method of imparting and using an angular rotation rate of a passing warhead to compensate for wiping effects without regard to specific hardware implementation.

Figure 12:
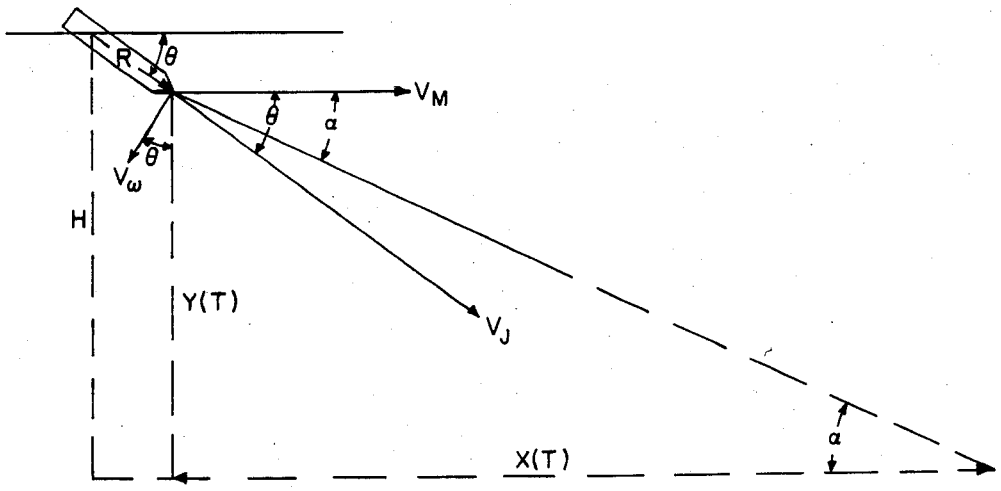
FIG. 12 illustrates the geometry of the present invention.

As such, the equation below define the limits of method feasibility. Referring to FIG. 12:

Where: $V_j(t)$=jet particle velocity along missile axis due to explosive jet formation.

$V_m$=jet particle velocity due to missile linear forward velocity.

$V_w$=jet particle velocity due to missile rotational angular rate.

$$\tan \alpha = \frac{Y(t)}{X(t)} = \frac{H - R \sin \theta}{X(t)} = \frac{V_y}{V_x}$$

where:

$V_y$ =resultant verticle jet particle velocity.

$V_x$=resultant horizontal jet particle velocity.

$$X(t) = \frac{V_x (H - R \sin \theta)}{V_y}$$

$$V_x = V_m + V_j(t) \cos(\theta_o + wt) - V_w \sin (\theta_o + wt)$$

$$V_y = V_j(t) \sin (\theta_o + wt) + V_w \cos (\theta_o + wt)$$

where:

$\theta_o$=missile angle at warhead initiate.

$\omega$=missile angular rate.

$$X(t) = \frac{[V_m + V_j(t) \cos (\theta_o + wt) - V_w \sin (\theta_o + wt)][H - R \sin (\theta_o + wt)]}{V_j(t) \sin (\theta_o + wt) + V_w \cos (\theta_o + wt)}$$

To calculate actual impact location of a jet particle, terms for missile translation and rotation about its center of gravity must be included.

$$X_J = X(t) + R \cos (\theta_o + wt) + V_{mt}$$

After calculating impact points of all parts at the jet, the extremes are located to define the extent of jet wiping. Thus, the designer can evaluate the effect of various parameter changes and select the most effective combination for a specific application.

We claim:

1. In a system whereby a projectile is directed at a target with a component of motion which will impart wiping, the improvement comprising a method having the step of providing a compensating angular rate to the projectile whereby the component causing wiping will be minimized.

2. A method as set forth in claim 1 further comprising the steps of guiding the missile above the target, remotely sensing an impending missile target approach, and commanding a thrust mechanism which imparts a desired pitch down angular rate to the missile.

3. A method as set forth in claim 1 further comprising the steps of providing the projectile with a warhead which will project a jet toward said target for melting a hole in armor of said target, and said jet being subject to the same compensating angular rate as said projectile.

4. A method as set forth in claim 3 wherein said projectile has a pitch rate imparting mechanism therein for causing the projectile to pitch and produce the compensating angular rate and utilizing the mechanism to impart an angular wiping which is equal and opposite to the wiping caused by said component of motion.

5. A system for directing a projectile towards a target having armor comprising first means for directing said projectile toward said target with a wiping component caused by projectile translation, said projectile containing a warhead for producing a jet for melting a hole in said armor, second means located on said projectile for producing an angular rate to the projectile and to the jet such that the angle of the attack of the jet on the target will change with the projectile translation and approximately cancel the translation of the jet about said armor; whereby the jet will be concentrated on a smaller area of the armorment than without the angle rate.

* * * * *